United States Patent [19]

Allen

[11] 4,111,385

[45] Sep. 5, 1978

[54] LASER BEAM RIDER GUIDANCE SYSTEM

[75] Inventor: John B. Allen, Richardson, Tex.

[73] Assignee: Texas Instruments Incorporated, Dallas, Tex.

[21] Appl. No.: 677,638

[22] Filed: Apr. 16, 1976

[51] Int. Cl.[2] ..... F42B 13/30; F41G 7/12; F41G 7/14; F41G 9/00

[52] U.S. Cl. ..... 244/3.13; 244/3.16

[58] Field of Search ..... 244/3.13, 3.16

[56] References Cited

U.S. PATENT DOCUMENTS

| | | | |
|---|---|---|---|
| 3,398,918 | 8/1968 | Girault | 244/3.13 |
| 3,690,594 | 9/1972 | Menke | 244/3.13 |
| 3,698,811 | 10/1972 | Weil | 244/3.13 |
| 3,746,280 | 7/1973 | Coxe et al. | 244/3.13 |
| 3,782,667 | 1/1974 | Miller, Jr. et al. | 244/3.13 |
| 3,964,053 | 6/1976 | Heiser | 244/3.13 |

*Primary Examiner*—Samuel W. Engle

*Assistant Examiner*—Thomas H. Webb

*Attorney, Agent, or Firm*—Rene' E. Grossman; Alva H. Bandy

[57] ABSTRACT

A laser beam rider guidance system having a launcher based electro-optical subsystem illuminating a light receiver subsystem on board a moving carrier is disclosed. A launcher based laser beam transmitter assembly transmits a synchronization beam, an $x$ scan beam, and a $y$ scan beam to the laser beam receiver subsystem along a line of sight established by a sighting means. The synchronization beam, $x$ scan beam, and $y$ scan beam when received by the receiver subsystem are used in a timing mechanism to measure the $x$ and $y$ scan times from the missile's position to the line of sight; each of these times are multiplied by the scan rate in a microprocessor to determine $x$ and $y$ coordinate direction correction signals necessary to position the carrier on the line of sight to target.

13 Claims, 28 Drawing Figures

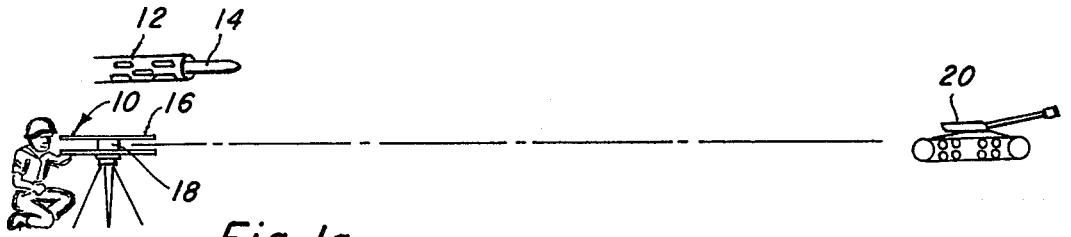
Fig. 1a
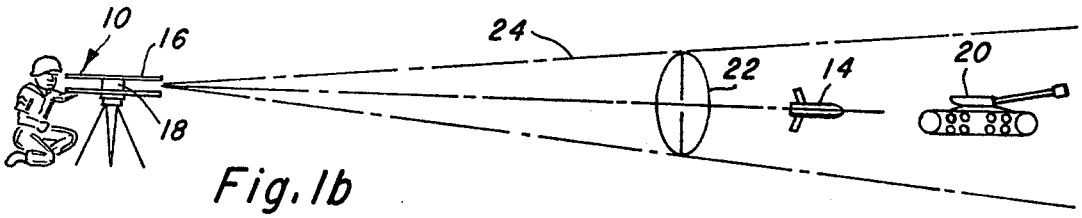
Fig. 1b
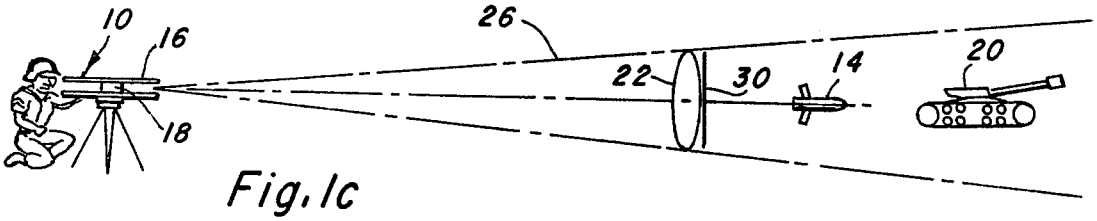
Fig. 1c
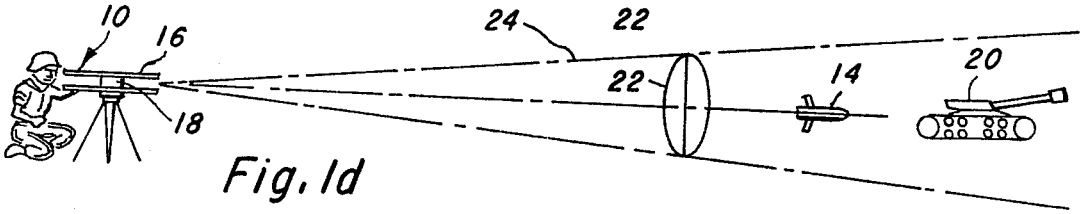
Fig. 1d
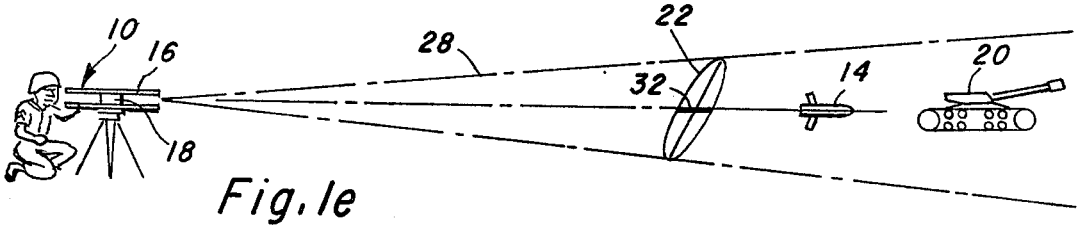
Fig. 1e
Fig. 2a
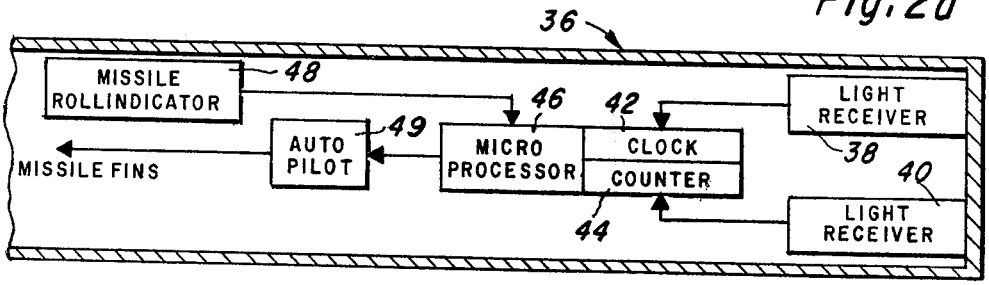

Fig. 8b
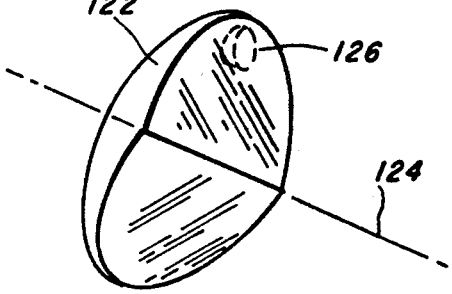
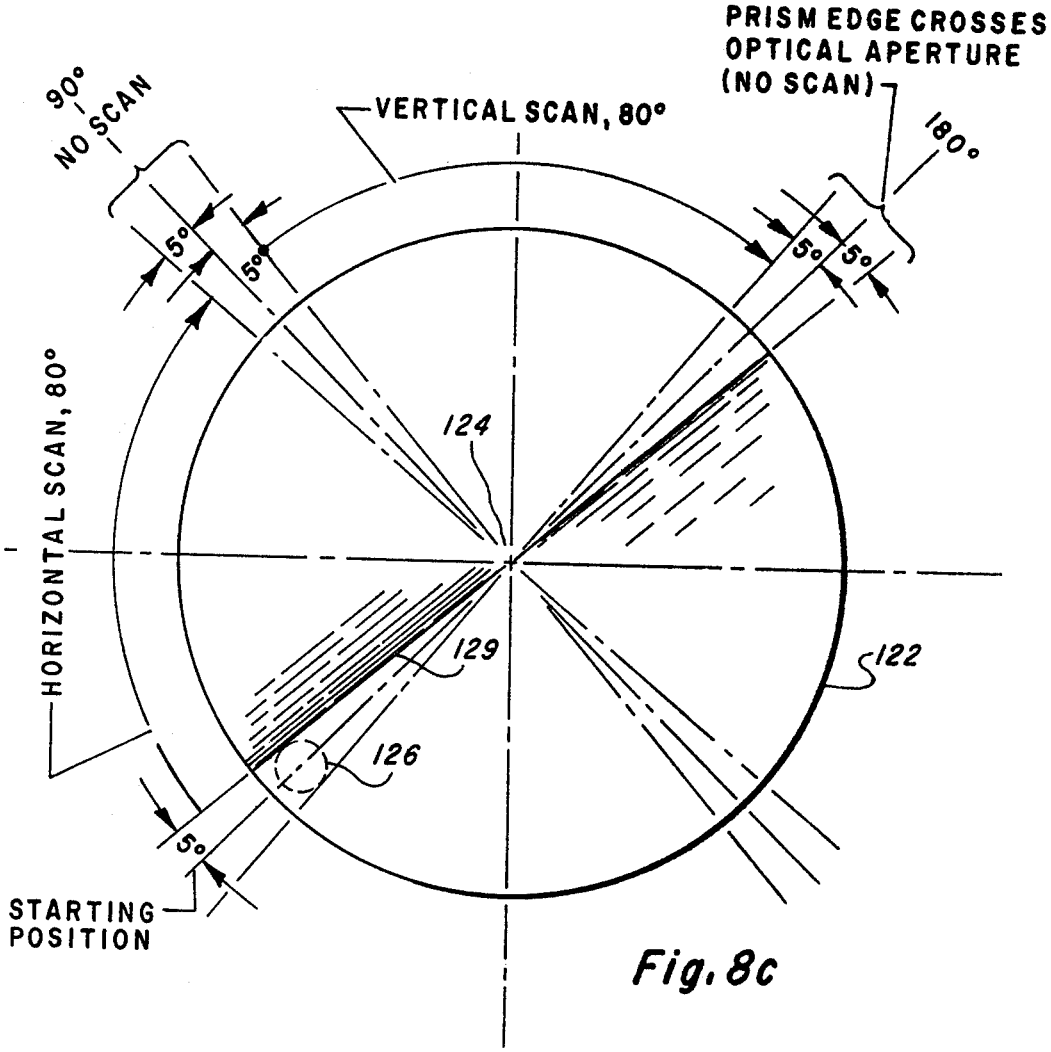
Fig. 8c

LASER BEAM RIDER GUIDANCE SYSTEM

This invention relates to electro-optical guidance systems, and more particularly, to a laser beam rider guidance system.

Beam rider guidance is a method of guidance whereby a moving carrier, such as a missile or the like is enabled to determine its relative position in a transmitted beam. The carrier generates guidance commands to correct its flight path toward the line of sight during flight to destination. A ground based operator establishes a laser beam along a line of sight to the missile's target destination and the carrier utilizes the transmitted beam to follow the line of sight to its destination. As the carrier generates its correctional commands internally, there is no requirement for correctional or tracking guidance from an external source.

In the past, beam rider guidance system concepts have been proposed for missiles and have included a laser beam aimed at a target. The beam has an intensity profile which is approximately Gaussian. The missile has two detectors positioned one on each side of the tail end of the missile or about 4 to 6 inches apart; the detectors measure relative intensity of the beam at these two positions. If the two readings are equal, the missile is on course; if not, the missile is moved toward the stronger portion of the beam and hence to its center. Problems exist with these systems in that a beam large enough to cover the area the missile will be in must be about 15 to 20 feet in diameter. Such a beam will have small intensity variation across the diameter of the missile. By putting the detectors on the missile fins, the spacing of the detectors may be extended, for example, to about 18 inches which will improve the amount of intensity difference, but this can only be done where the aerodynamics of the missile will not be adversely affected. A more serious problem exists perhaps because of atmospheric turbulence which can cause the beam intensity to vary by a ratio of 20 to 1 making intensity measurements unreliable.

Further prior art beam rider missile guidance systems have utilized a four beam technique. In the four beam technique four forming quadrants of a circle are positioned on the center of a target. The four beams are coded in various manners such as, for example, by pulse repetition frequencies so that the missile can detect the presence of each beam. The four beam pattern is nutated in space by the beam transmitter. A detector aboard the missile detects the presence of the beams. A signal processor receives the detector signal and measures the length of time that each beam is present on the detector. If the signal processor determines that the duration of each of the four beams on the detector is the same for one nutation, the missile is on the line of sight. The missile's position can be directly related to the relative lengths of time each beam is present on the detector. Such systems are complex in that light pipes and beam forming optics are required to convert the long and narrow beams of laser diode sources into the shape of quadrants of a circle.

In another prior art system, the tracker and missile comprise, respectively a laser transmitter at the guidance unit and a narrow band laser receiver at the rear of the missile. Two gallium arsenide lasers provide the radiant energy. An L shaped image pattern is generated by transmitting through two rectangular fiber optics exit apertures. This pattern is nutated and projected into space at a constant 6 m in diameter during missile flight. Optical focus at the laser receiver on the missile is accomplished by using a zoom lens which is programmed by a digital stepper controlled by a read-only member chip to follow the nominal missile range as a function of time from firing. The beam pattern is nutated at 56 Hz and the frequency of the output of each aperture is varied with the phase of the nutation cycle. The azimuth and elevation components of the missile's deviation from line-of-sight are determined from the modulation frequency detected by the missile receiver as the image projected by each aperture sweeps by the receiver. The transmitter frequency of each of the laser emitter diodes is varied over separate pulse repetition frequency (PRF) ranges with the phase of the nutational cycle. This FM sweep is generated digitally in 50 discrete steps so that the frequency at any nutational position is determined. Thus, the receiver detects the frequency corresponding to that position of the nutational cycle. This enables the signal processor aboard the missile to measure the horizontal and vertical components of deviation from line-of-sight and generate the necessary azimuth or elevation correction signal. The problem with this system is threefold, namely, it suffers from zoom lens wander (translation of the optical axis of the lens due to the motion of the zoom lens); secondly, it is susceptible to signal dropout owing to atmospheric turbulence or scintillation; and thirdly, as the missile location signal interval is subtracted from a precalculated boresight interval the correction signals are subject to boresight errors in that the position error may not be exactly zero when the missile is on the line of sight. It is highly desireable in such a system to have all errors vanish when the missile is at or near the line of sight.

Accordingly, it is an object of this invention to provide a laser beam rider guidance system which is simple in construction, economical to manufacture, and highly reliable and accurate.

Another object of the invention is to provide a laser beam rider guidance system whose correctional signals are a function of time, thereby reducing atmospheric scintillation errors.

Still another object of the invention is to provide a laser beam rider guidance system in which the total amount of emitted light reaching target is small to avoid alerting the target to the fact that a missile is about to be launched.

Yet another object of the invention is to provide a laser beam rider guidance system in which the efficiency is not a function of any variation in the light intensity of a beam or beams.

A further object of the invention is to provide a laser beam rider guidance system whose error signals are substantially linearly related to the quantity measured, namely, time.

Still a further object of the invention is to provide a laser beam rider guidance system having an increased operating efficiency.

Still yet a further object of the invention is to provide a laser beam rider guidance system whose guidance signals are independent of zoom lens wander and time to boresight precalculations.

Briefly stated, the laser beam rider guidance system comprises a launcher based electro-optical subsystem and a light receiver subsystem which is aboard a carrier. The carrier may be, for example, a missile, and for purposes of description, but not for limitation, a missile will be used as the carrier. The launcher based electro-optical subsystem includes a laser beam transmitter assembly and an optical sighting assembly. The on-board light receiver subsystem includes a light receiver assembly and a guidance correction signal producing assembly. The laser beam transmitter assembly includes a laser means for producing a pair of long, narrow, scanning, laser beams and a synchronization beam. The scanning beams are mutually perpendicular one to the other for scanning in a horizontal ($x$) direction and a vertical ($y$) direction, and the synchronization beam is a broad reference beam for illuminating the missile responsive to the scanning beams crossing the center of the optical sighting subassembly. It will be appreciated that other means for establishing a line of sight to target can be utilized.

The on-board light receiver subsystem includes light sensor means for sensing receipt of either a $x$ or $y$ scan beam followed by a synchronization beam, or a synchronization beam followed by an $x$ or $y$ scan beam for guidance correction signal producing assembly. The receipt sequence determines the sign of the guidance correction signal. The guidance correction signal producing assembly includes: a clock, a counter, and a microprocessor. The microprocessor is programmed: to search out receipt of valid signal sequences; to determine time between receipt of $x$ and $y$ scan beam signals and their respective synchronization signal; and to compute (by multiplying the $x$ and $y$ scan times, respectively, by the rate of scan expressed in distance scanned per unit time) guidance correction signals for the missile guidance system to return the missile to the line-of-sight to target.

The laser means for producing the pair of long, narrow, scanning, laser beams includes in one embodiment a pair of oscillating junction laser diodes. The junctions are mutually perpendicular in the vertical and horizontal planes to provide $x$ and $y$ scan beams. In another embodiment the pair of diodes are stationary and their beams are scanned by "flopping" mirrors. In still another embodiment, a laser diode having L shaped junctions replaces the stationary pair of diodes and a rotating wedge prism is substituted for the flopping mirror to scan the L shaped diode laser. In a final embodiment a double wedge prism replaces the single wedge prism as the L shaped diode laser scanner to improve the scanning efficiency by a factor of four.

Each embodiment of the laser means for producing the pair of long, narrow, scanning, laser beams is used in conjunction with the optical sighting subsystem. The optical sighting subsystem includes a beamsplitter arrangement for reflecting a portion of the $x$ and $y$ scan beams through a modified telescope sight. The telescope sight includes a beamsplitter in front of the sight reticle. The sight reticle includes crosshairs which have a reflector dot at their center to reflect the portions of the $x$ and $y$ scan beams when they cross the line-of-sight to the beamsplitter. The beamsplitter in turn reflects the portions of the $x$ and $y$ scan beams to a light detector. The light detector generates a signal used to trigger the synchronization beam laser to illuminate the missile light sensor means.

The novel features of the invention are pointed out with particularity in the appended claims. However, the invention itself, together with further objects and advantages thereof, may best be understood by reference to the following description taken in conjunction with the accompanying drawings in which:

FIGS. 1a–1e represent the laser beam rider guidance transmitter cycle of the invention;

FIG. 2a is a block diagram of one embodiment of the missile light receiver subsystem;

FIG. 8b is an isometric view of the double wedge prism of the fourth embodiment of FIG. 8a;

FIG. 8c is a plan view showing for the embodiment of FIG. 6 the position of the double wedge prism in its scanning relationship to the optical aperture during one revolution.

Figure 2B:
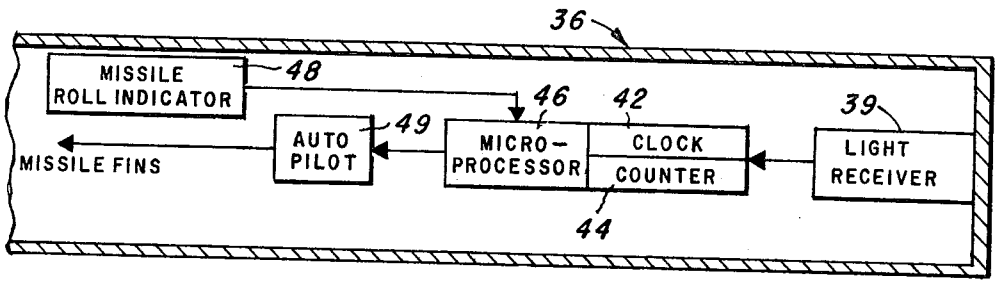
FIG. 2b is a block diagram of another embodiment of the missile light receiver subsystem.

Referring now to FIG. 1a, the beam rider guidance system construction comprises a ground based station 10 positioned near a missile launcher tube 12 containing a missile 14. The ground based station 10 includes an optical sighting assembly 16 and a laser beam transmitter assembly 18. The laser beam transmitter assembly 18 is aligned with a target 20 by sighting the target through the optical sighting assembly 16. With the line of sight to target established, the missile 14 is launched from missile launch tube 12 into the missile guidance beam pattern 22 (FIG. 1b). The missile guidance beam pattern 22 is defined by the synchronization beam 24 (FIGS. 1b and 1d) and $x$–$y$ scan beams 26 and 28 (FIGS. 1c and 1e). The synchronization beam pattern 22 (FIGS. 1b and 1d) has a cross section which is preferably circular and has a diameter of between about 15 to 20 feet at a missile target range of about 3000 meters. Simultaneously, with the firing of the missile the laser beam transmitter assembly cycle begins to operate. The $x$ scan beam 30 (FIG. 1c) is produced first by the laser beam transmitter assembly 18. The $x$ scan laser beam is a long, narrow, vertical beam (10 to 100 times as long as it is wide) which scans left to right (horizontally) from a point outside the missile guidance beam pattern 22, across the pattern to a point outside the pattern. When the $x$ scanning beam crosses the line of sight to target 20 the synchronization beam 22 (FIG. 1b) is pulsed in a coded manner (hereinafter described) toward the target 20. After the $x$ scanning beam 30 leaves the beam pattern 22, a long narrow $y$ scan beam (10 to 100 times as long as it is wide) (FIG. 1e) which is disposed horizontally to the beam pattern 22 begins to scan from a point above the pattern 22 vertically across the pattern to a point below the pattern. As the $y$ scan beam crosses the line of sight, the synchronization beam 22 is again pulsed in a second coded manner (FIG. 1*d*) to complete one laser beam transmitter assembly cycle. The details of the signals and cycle frequency will be disclosed hereinafter.

As the missile 14 enters the missile guidance beam pattern 22, its on board light receiver subsystem 36 (FIGS. 2*a* and 2*b*) will begin to operate responsive to the $x$ or $y$ scan beams 30–32 or synchronization beam 24 whichever is first received. The design of the receiver subsystem 36 depends on the nature of the laser beam transmitter assembly signals. For example, if the $x$–$y$ laser scan beam and the synchronization beam are the same wavelengths, they are distinguishable by pulse lengths or spacings or both and only one laser beam (light) sensor 39 is required (FIG. 2*b*). For another example, if the $x$–$y$ laser scan beams and synchronization beams are of different wavelengths, they are distinguishable by three laser beam sensors. As a final example, if the $x$–$y$ laser scan beams are of the same wavelengths and the laser synchronization beam has a wavelength that differs from that of the $x$ and $y$ laser scan beams, they are distinguishable by two laser beam sensors and a suitable code (FIG. 2*a*). As the implementation of each example is within the skill of the art only the latter which is a combination of both of the preceding examples will be described. Either of a pair of light receivers 38 and 40 (FIG. 2*a* ) responsive to different light wavelengths receive a signal to start a timer clock 42, and counter 44. A microprocessor 46, upon receipt of a signal from either light sensor 38 or 40 which exceeds a threshold voltage, reads and resets the counter 44. The value in the counter is stored in the microprocessor. Thus, the microprocessor stores the time intervals between pulses. When a time interval corresponding to a synchronization beam is found, the microprocessor program searches for a time interval corresponding to a scan beam pulse separation. Usually three or four scan beams are present in each $x$ or $y$ coordinate update. The total time between the reception of the synchronization beam and the centroid of the three or four scan beams is directly related to the $x$ or $y$ coordinate displacement of the missile. The microporcessor is programmed to determine whether the centroid of the scan beams occurred before or after the synchronization beam to determine the sign of the coordinate; if, for example, the synchronization beam pulse separation is that for the $x$-scan, the update is for the $x$-coordinate. If the synchronization beam pulse separation is that for the $y$ scan, the update is for the $y$-coordinate. The microprocessor 46 also obtains roll data from the missile roll indicator 48 to apply the guidance correction signals through an autopilot 49 to the appropriate missile fins for correcting the flight of the missile. It will be understood, of course, that until the missile enters the missile guidance beam pattern 22 the transmitter laser beams are not received by the light sensors of the missile. If we assume that the missile 14 enters the missile guidance beam pattern 22 to the left of the line of sight to target and below it (Quadrant III) at the time the $x$ scan beam 30 is beginning its scan at the left side of the beam pattern 22, light reciever 38, which is responsive to the $x$ and $y$ scan beam wavelength, detects the $x$ scan beam and produces a signal to start the clock 42. The $x$ and $y$ scan beams may have a wavelength of, for example, 0.904 microns. The counter 44 continues to count until the $x$ scan beam 30 crosses the line of sight. Upon crossing the line of sight, the synchronization laser is activated to transmit a $x$-scan synchronization coded pulse 24 which is received and passed by light receiver 40 to the microprocessor which processes the $x$ coordinate guidance correction signal. After the $x$ scan is completed, the $y$ scan begins. As the missile is below the line of sight, the $y$ laser scan beam 34 crosses the line of sight and a second coded laser synchronization beam 22 is produced and detected by light receiver 40 and passed to start the counter 44 which continues to count until the $y$ scan beam crosses the $y$ light receiver 38. Upon detection of the $y$ scan beam by the receiver 38, the clock is stopped and reset. The microprocessor then computes a $y$ direction correction signal in the same manner as the $x$ direction correction signal was computed for the missile guidance system.

Figure 3:
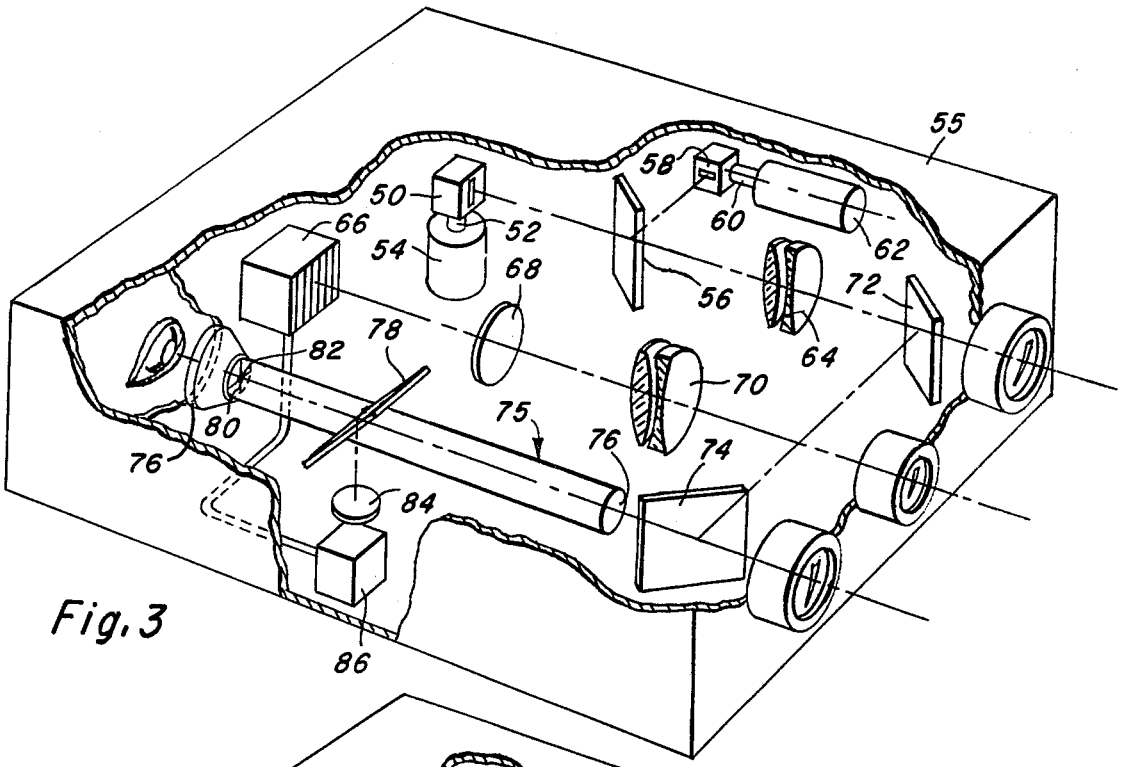
FIG. 3 is an isometric view of an embodiment of the beam transmitter system.

Referring now to FIG. 3 for a description of a first embodiment of the launcher based laser beam transmitter assembly of the laser beam rider guidance system. This embodiment (FIG. 3) includes a laser 50 which may be, for example, a gallium arsenide laser diode emitting a long, narrow, vertical beam of light for the $x$ scan beam 30. The $x$ scan beam is 10 to 100 times as long as it is wide. The laser 50 is reciprocally mounted upon a drive shaft 52 of a galvanometer 54. Galvanometer 54 is mounted in a housing 55 to translate the laser 50 perpendicular to its junction clockwise in the focal plane along the $x$ coordinate axis to provide the $x$ scanning beam 30. The laser 50 is pulsed off during fly back, i.e., right to left movement. The laser 50 is, for example, positioned behind a beamsplitter 56 with its beam passing through its nonreflecting portion. A second laser 58, which may be identical to laser 50, is provided to produce a long, narrow, horizontally disposed $y$ scan beam 32. Laser 58 is mounted for reciprocal movement on a drive shaft 60 of galvanometer 62. Galvanometer 62 may be identical to galvanometer 54 and is mounted in housing 55 to translate the laser 58 perpendicular to its junction from top to bottom to produce the $y$ scan laser beam 32. The laser 58 is pulsed off during fly back, i.e., bottom to top movement. The $y$ scan beam 32 of laser 58 is directed toward the reflecting surface of beamsplitter 56 for reflection along the focal plane. A zoom lens 64 is mounted in the housing 55 in the combined focal plane path of the $x$ and $y$ laser scan beams 30 and 32 to image the junctions of the laser beams in space over approximate range of the missile 14. Zoom lens 64 may be, for example, an f4.5 lens.

The synchronization beam producing laser 66 is mounted in housing 55 to produce the missile guidance synchronization beam 24. The synchronization laser 66 is so positioned in the housing 55 relative to the scanning lasers 50 and 58 to produce a missile guided beam pattern 22 which can be properly scanned by the $x$ and $y$ scan laser beams 30 and 32. The synchronization laser 66 may be any laser which produces a nearly circular beam pattern. Such a laser may be, for example, an array of five laser diodes with parallel junctions whose rectangular beams are passed through an imperfect lens 68. The lens 68 may have sufficient aberations therein to produce the substantially circular synchronization beam pattern 22. Other lens arrangements can be used to obtain the desired circular beam pattern. Zoom lens 70 images the circular laser beam 24 in space at the approximate range of the missile.

An electro-optical sighting assembly is used to establish the line of sight to target and trigger the synchronization beam. The electro-optical sighting assembly includes a beam-splitter 72 positioned in the combined $x$ and $y$ light path in front of the $x$ and $y$ scanning zoom lens 64 to reflect a portion of the $x$ and $y$ scanning beams to the reflecting portion of a second beamsplitter 74. The beamsplitter 74 reflects the $x$ and $y$ laser beam portions through a modified telescope sight 75. The modified telescope includes a visual lens 76, a third beamsplitter 78, and a reticle 80. Reticle 80 has a reflector 82, which may be, for example, an aluminum dot, at the center of its crosshairs to reflect the portions of the $x$ and $y$ laser scanning beams to the reflecting surface of the beamsplitter 78. Portions of the $x$ and $y$ scanning beams will strike the center of the reticle only when they are in alignment with the line of sight of the telescope. Thus, when the telescope sight is on target, the line of sight to target is established. Reticle 80 is provided with a coating shield to shield the operator's eyes from the portions of the laser beams. The beamsplitter 78 reflects the $x$ and $y$ laser beam portions through a focusing lens 84 to a light detector 86. Light detector 86 may be, for example, a photodiode. Detector 86 produces an electrical signal each time the $x$ and $y$ scan beams cross the line of sight to target. The electrical signal actuates the pulser of synchronization laser diode array 66. In this arrangement, it will be appreciated by those skilled in the art that the $x$ and $y$ scanning lasers scan only once per oscillation each. Thus, for an update rate of 25 Hz, the scanning lasers must oscillate 3,000 times per minute and their drive galvanometers 54 and 62 be synchronized to alternately sequence the $x$ and $y$ scan beams into the focal plane.

Figure 4:
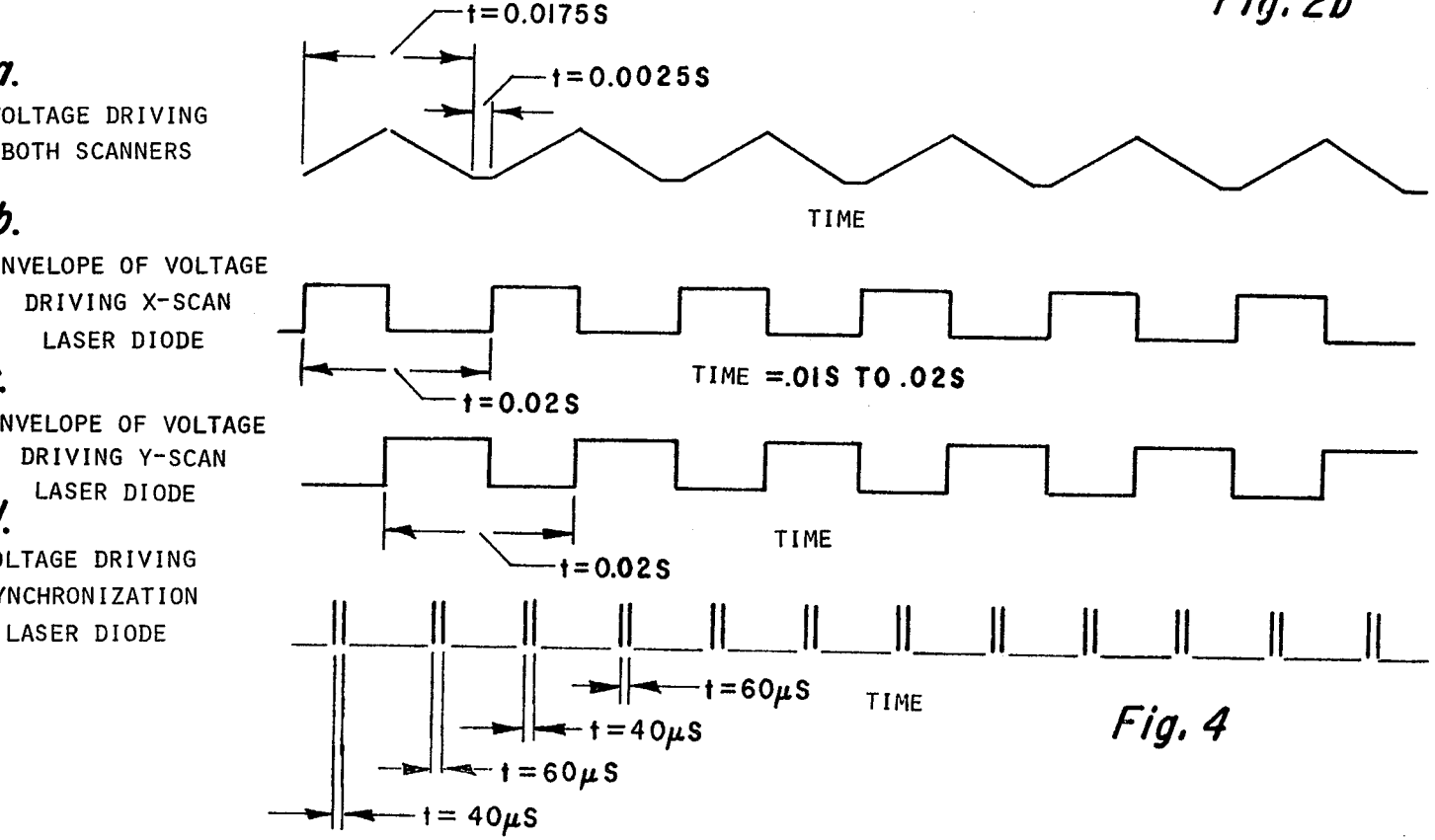
FIGS. 4a–4d are representations of the voltage waveforms driving the signal transmitter components of the embodiment of FIG. 3.

The $x$ and $y$ scan driving galvanometers 54 and 62 are driven by a voltage shown in FIG. 4*a*. The voltage increases during the first 180° (0°–180°) and decreases during the next 180° (180°–360°) of each oscillation. The duration of the oscillation is 0.0175 seconds and each oscillation is followed by a dead time of 0.0025 seconds. Thus, the total period time is 0.02 seconds and the missile update signal frequency is 25 times a second. It will be appreciated that other update frequencies can be used without departing from this particular arrangement. The dead time provides a simple code for indicating the end of each $x$–$y$ scan cycle. The envelope voltage for the $x$ and $y$ scan lasers 50 and 58 are shown, respectively, in FIGS. 4*b* and *c*. The $x$ and $y$ scan lasers 50 and 58 are pulsed at a 7500 pulse/second rate; each pulse is for 100 ns. The synchronization signal for each $x$ and $y$ scan consists of two 100 ns pulses, each spaced, respectively, at 40 and 60 microsecond intervals. The on board light receiver subsystem (FIG. 2) is designed to accept only signals at these intervals as valid signals and to reject any invalid scan. The 25 Hz updating frequency has been found adequate to provide sufficient scans to keep the missile on the line of sight to target.

Figure 5:
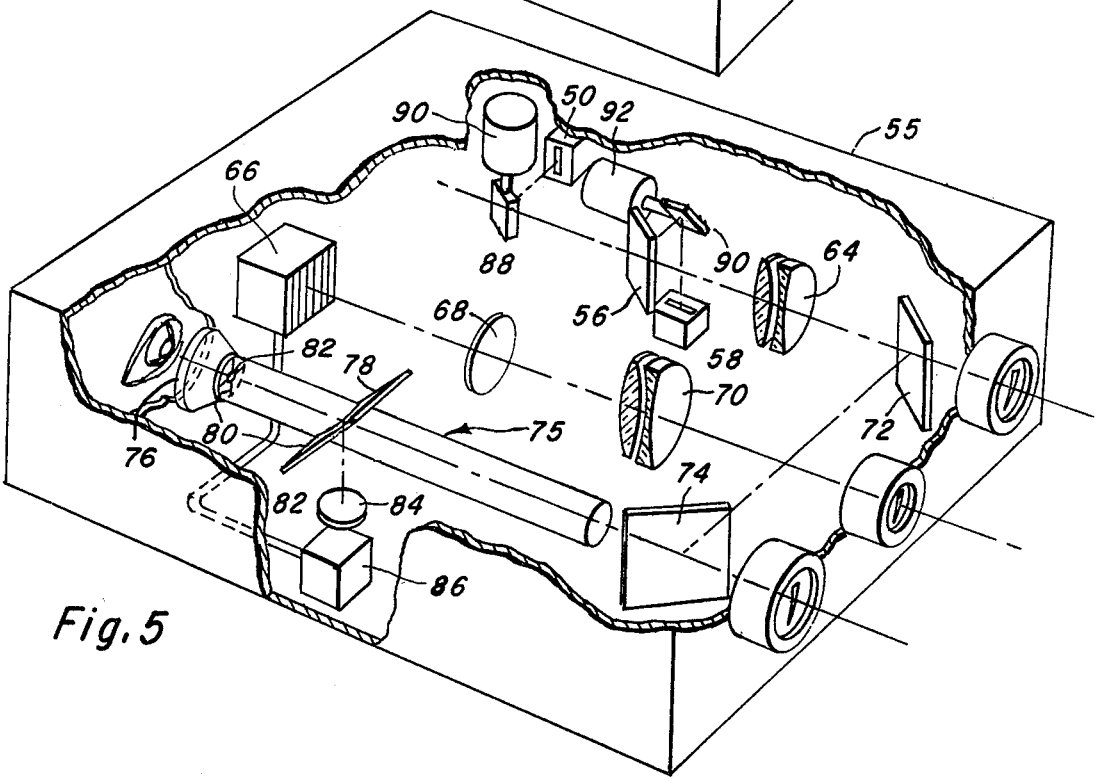
FIG. 5 is an isometric view of a second embodiment of the laser beam rider transmitter.

Turning now to FIG. 5 for a second embodiment of the laser beam rider transmitter assembly. In this embodiment like numbers will be used to designate parts which are similar to those of the first embodiment. In this embodiment the laser 50 is stationarily mounted in housing 55 with its light emitting junction in a vertical position. Light from the vertical junction of the diode laser strikes an oscillating scanning mirror 88. Scanning mirror 88 may be, for example, a silver polished mirror mounted for oscillation on the drive shaft of a galvanometer 90. Scanning mirror 88 oscillates the laser beam to produce an $x$ scanning beam 30 moving from left to right. The $x$ scan laser beam is pulsed off during mirror fly back. Scanning mirror 88 reflects the $x$ scanning laser beam through zoom lens 64. Laser 58 is stationarily mounted in housing 55 as is laser 50. However, its light emitting junction is horizontally disposed to produce a $y$ scan beam. Scanning mirror 90 is mounted for oscillation on the drive shaft of a galvanometer 92 mounted in the signal transmitter housing 55 at right angles to the $x$ scan galvanometer 90 to produce a $y$ scan beam. Scanning mirror 90 may also be, for example, a silver polished mirror to reflect the $y$ scanning light beam through beamsplitter 56 and zoom lens 64. The electro-optical sighting assembly and synchronization beam subassembly is that of the first embodiment (FIG. 3) and need not be described again. The voltage waveforms driving the transmitter components of this embodiment are identical to those shown in FIG. 4 for the first embodiment.

Figure 6:
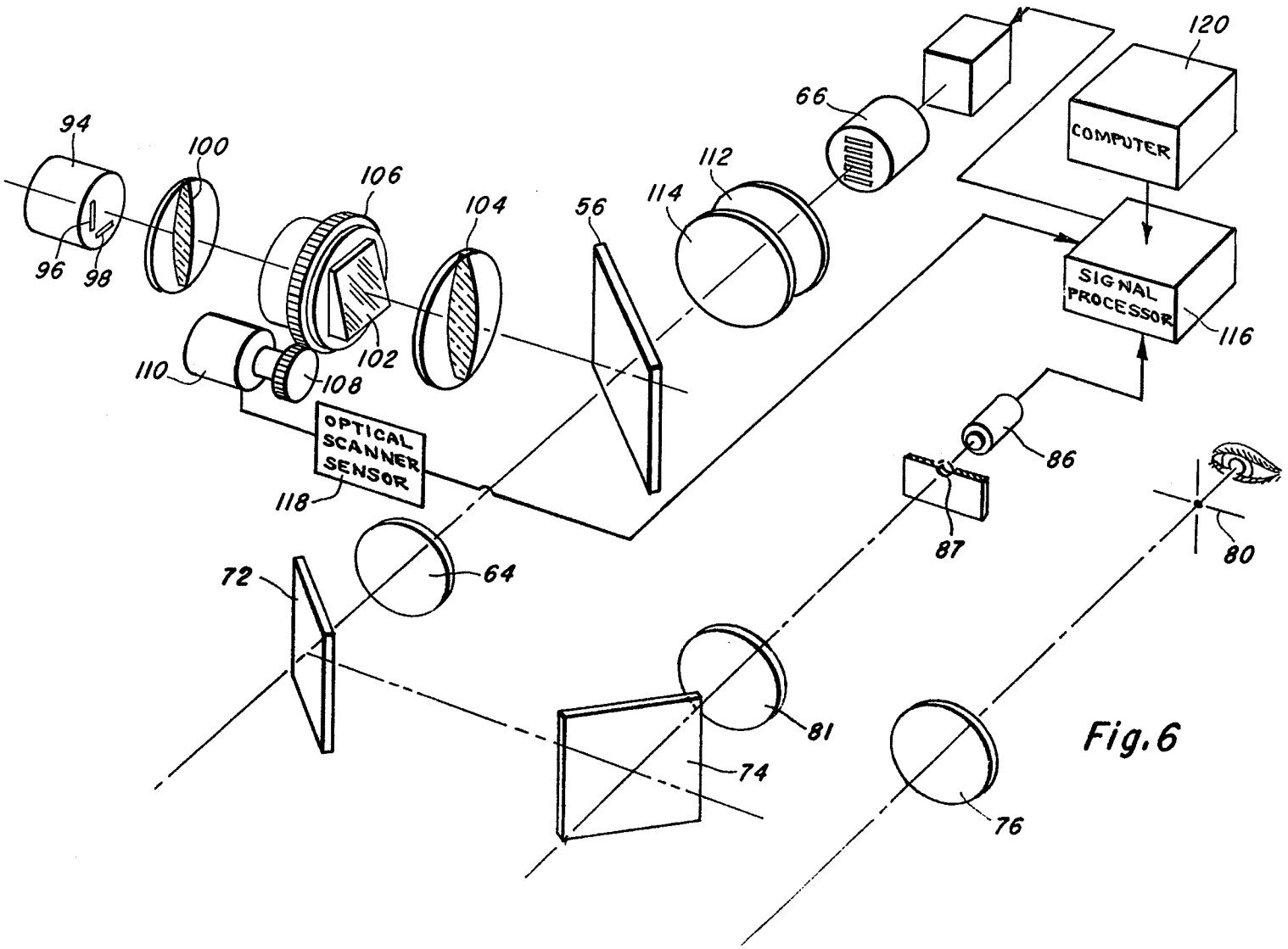
FIG. 6 is a schematic of a third embodiment of the laser beam transmitter system.

Turning now to FIG. 6 in which is shown schematically a third embodiment of the laser beam transmitter assembly in which similar reference numbers are used to designate like parts. The laser 94 is an "L" junction laser diode stationarily mounted in a housing similar to housing 55 for emitting light having a 0.904 micron wavelength. It has a first *p-n* junction 96 vertically disposed as to the line of sight to missile for providing an $x$ scan beam, and a second *p-n* junction 98 horizontally disposed as to the missile line of sight to provide a $y$ scan beam. The $x$ and $y$ scan beams are passed through relay lens 100, scanner 102 and relay lens 104 to the reflection portion of beamsplitter 56. The relay lenses 100 and 104 are light collimating lenses, and scanner 102 is, for example, a wedge prism mounted for rotation in a plane normal to the laser beams. By rotating the wedge prism the laser beams are rotated for $x$ and $y$ scanning of the optical path about the line of sight to target. The beamsplitter 56 reflects the $x$ and $y$ scanning beams of laser 94 along the optical path to the target. The scanning prism 102 is mounted in a frame 106 whose outer periphery forms a gear engaging a drive gear 108 attached to the drive shaft of motor 110. As the scanning wedge requires two revolutions for the $x$–$y$ scan cycle, scanner 102 is rotated at about 3,000 rpm to provide the $x$ and $y$ scans for a 25 Hz update mode of operations. Synchronization laser 66 is mounted in the housing (not shown) in optical alignment with relay lenses 112 and 114 and beamsplitter 56. Zoom lens 64 is positioned in the combined optical path of the $x$–$y$ scanning beams and synchronization beam to image them at the approximate ranges of the missile to target. Beamsplitter 72 is positioned to reflect a portion of the imaged $x$ and $y$ scanning beams to beamsplitter 74 of the electro-optical sighting assembly which includes a modified telescope sight for establishing line of sight to target and triggering a synchronization beam. Beamsplitter 74 reflects the portion of the $x$ and $y$ scan beams through a focusing lens 81 for focusing the scan beams through an aperture 87 onto the detector 86 when the scan beams cross the line of sight. The detector 86 alternately receives the $x$ and $y$ scan beams from the "L" shaped diode 94, and the detector's output signals are applied to a signal processor 116. The telescope sight includes a visual lens 76 and a reticle 80 mounted in a telescope housing (not shown). The visual lens 76 and focusing lens 81 are rigidly mounted in a housing (not shown) so that their optical axes are parallel one to another. In this arrangement the apertured detector 86 receives light that is parallel to the visual axis only. Thus the apertured detector per-forms the functions of the reticle's reflector dot of FIGS. 3 and 5.

The signal processing unit 116 also receives, in addition to the detector 86 signals, electrical signals from an optical scanning position sensor 118, coupled to scanner drive motor 110, to identify which laser junction 96 or 98 is producing the beam detected by the detector 84 and a gravitational force signal and target lead signal from a computer 120 programmed to compute these signals. The signal processor 116 determines: a lead time correction signal for the synchronization laser beam signal, and a gravitational force correction signal for the $y$ synchronization laser beam as follows. Assuming the target is moving and the beam is scanned in the same direction the following procedure is carried out. As the scan beam crosses boresight, a signal is produced by the detector 86. The synchronization beam is flashed at a time $t - \Delta t$ seconds after the detector has produced the signal rather than at the same instant the detector produces a signal; "$t$" is the period of the scanner and $\Delta t$ is a programmed time interval proportional to the desired lead. If the target is moving in a direction opposite to direction of scan, the synchronization beam is flashed at a time $t + \Delta t$ after the receipt of the pulse from the detector. $\Delta t$ is proportional to the desired lead. Gravitational force (G bias) information is imparted in a similar manner. If a vertical scan beam is scanned in the direction opposite to greater, the synchronization beam for the $y$ beam is flashed "$t$" seconds after the pulse is produced by the detector 86. "$t$" is proportional to displacement in the vertical direction needed to compensate for gravity.

The voltage waveforms for embodiment of FIG. 6 are shown in FIG. *7a–7d*. FIG. *7a* is the cosine of the phase of the scanning wedge prism as determined by the optical scanning position sensor 118. As previously noted two revolutions of the single wedge scanner is required to produce $x$ and $y$ scan beams. Thus, for an update rate of 25 Hz the scanning wedge must be rotated at a rate of 3,000 revolutions per minute. For left to right scanning, the scanning wedge is rotated 180° and the laser 94 turned on for the next 180° (180° thru 360°) of wedge rotation (FIG. *7b*); the laser is turned off during the next 90° of wedge rotation, then turned on for the $y$ scan which is for the next 180° (90° to 270°) of wedge rotation (FIG. *7c*); and then turned off for 90° (270° to 360°) of wedge rotation. This cycle is then repeated 25 times per second. As shown in FIG. *7d* each time the $x$ and $y$ scan diodes cross the center of the telescope, coded synchronization signals are transmitted. As shown in FIG. *7d* the $x$ and $y$ synchronization signals consist of, respectively, pairs of beam pulses spaced, respectively, at 40 and 60 microseconds intervals.

Referring now to FIGS. *8a–8d* for a fourth modification of the embodiment of the laser beam transmitter assembly. This embodiment differs from that of FIG. 6 only in that the stationary "L" shaped laser 94 is scanned by a double wedge prism 122 (FIGS. *8a* and *8b*). The double wedge shaped prism 122 (FIG. *8a*) is rotatably mounted in the laser beam transmitter assembly housing (not shown) with its center of rotation 124 at 45° to the $x$–$y$ scanning beams of the "L" shaped laser 94 (FIG. *8a*). A collimating lens 121 collimates the laser beams of p-n junctions 96 and 98 to form an optical aperture 126 Thus, when the double wedge prism 122 is rotated (FIG. *8c*) each wedge thereof crosses the optical aperture 126 once each revolution. The direction of deviation of each wedge of the double wedge prism 122 is opposite to that of the other. Thus, the aperture 126 is scanned by the first wedge during 180° of double wedge rotation, and similarly scanned again by the second wedge during the next 180° of double wedge rotation. The geometry of the nutating scan (FIG. *8d*) is such that the vertical scan beam 98' is outside the field of view 127 (FIG. *8d*) during the horizontal scan, and the horizontal ($x$) scan beam 96' is outside the field of view 127 during the vertical scan. Thus, for example, during one revolution of the double edge prism 122 (FIG. *8c*) no scan action occurs for the first 5° (0°–5°) movement during which time the edge 129 of the prism 122 is within the optical aperture and the $x$ scan beam 96' moves into scan position (FIG. *8d*(i)). Next, during 80° (5°–85°) of rotation (FIG. *8c*) a horizontal (x) scan of the field of view 127 is accomplished by $x$ scan beam 96' whilst the $y$ scan beam 98' moves into scan position outside the field of view (FIG. *8d*(ii)). The movement of the beams is produced by the rotating first wedge of the double wedge prism 122. During the next 10° (85°–95°) of rotation (FIG. *8c*) no scanning by either beam occurs, but the $y$ scan beam 98' moves close to the field of view (FIG. *8d*(iii)) and the $x$ scan beam 96' moves to a noninterfering position. Then in the following 80° (95°–175°) of rotation (FIG. *8c*) the $y$ beam 98' of the $y$ scan laser 98 scans the field of view (FIG. *8d*(iv). The $y$ scan is followed by another 10° (175°–185°) of rotation (FIG. *8c*) during which no scan occurs and the edge 129 of the double wedge crosses the optical aperture 126.

As the double wedge prism has rotated 185° the optical aperture is on the second wedge and as its deviation direction is opposite that of the first wedge, the 185° rotation makes the second wedge appear to the aperture 126 to be in the same position as the first wedge was at the beginning of the cycle. Thus the scanning process is repeated during the next 180° of rotation and the scanning action of the field of view is repeated as shown in FIG. *8d*(i–iv). In this manner two horizontal and two vertical scans of the field of view are achieved in one rotation of the double wedge shaped prism 112. This can be contrasted with the single wedge prism which required two rotations for each scan cycle. Thus, this latter scanning method is symmetrical in time and has four times more scans per revolution than where the "L" shaped diode is scanned by the rotating optical wedge of FIG. 6. The arrangement of the double wedge prism allows increased spacing of the p-n junction of the diodes from their intersection point, thereby eliminating a requirement for fiber optics to form the "L" shaped laser beams.

Figure 7:
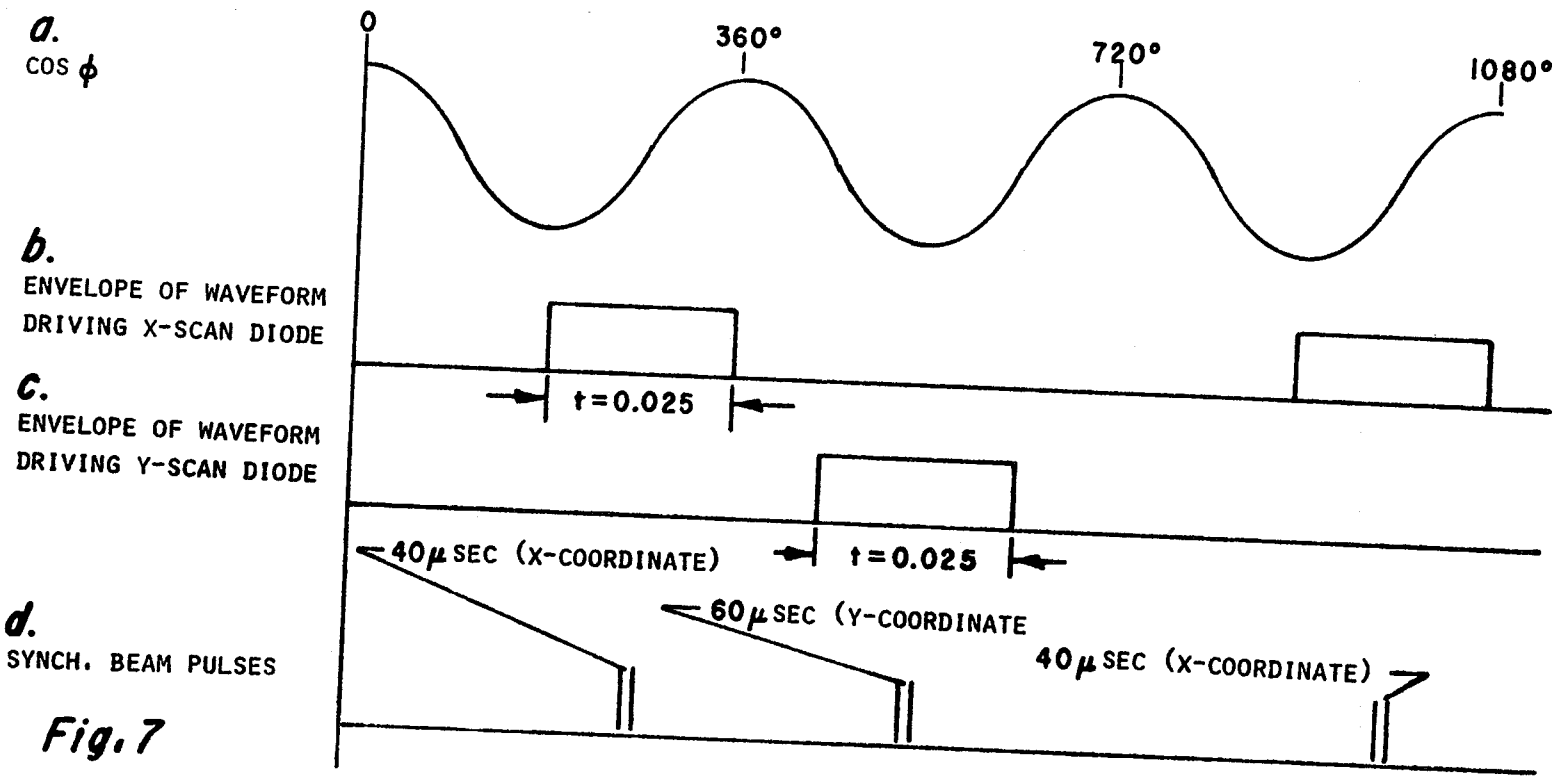
FIGS. 7a–7d are representations of the voltage waveforms driving the laser beam transmitter components of FIG. 6.
Figure 8A:
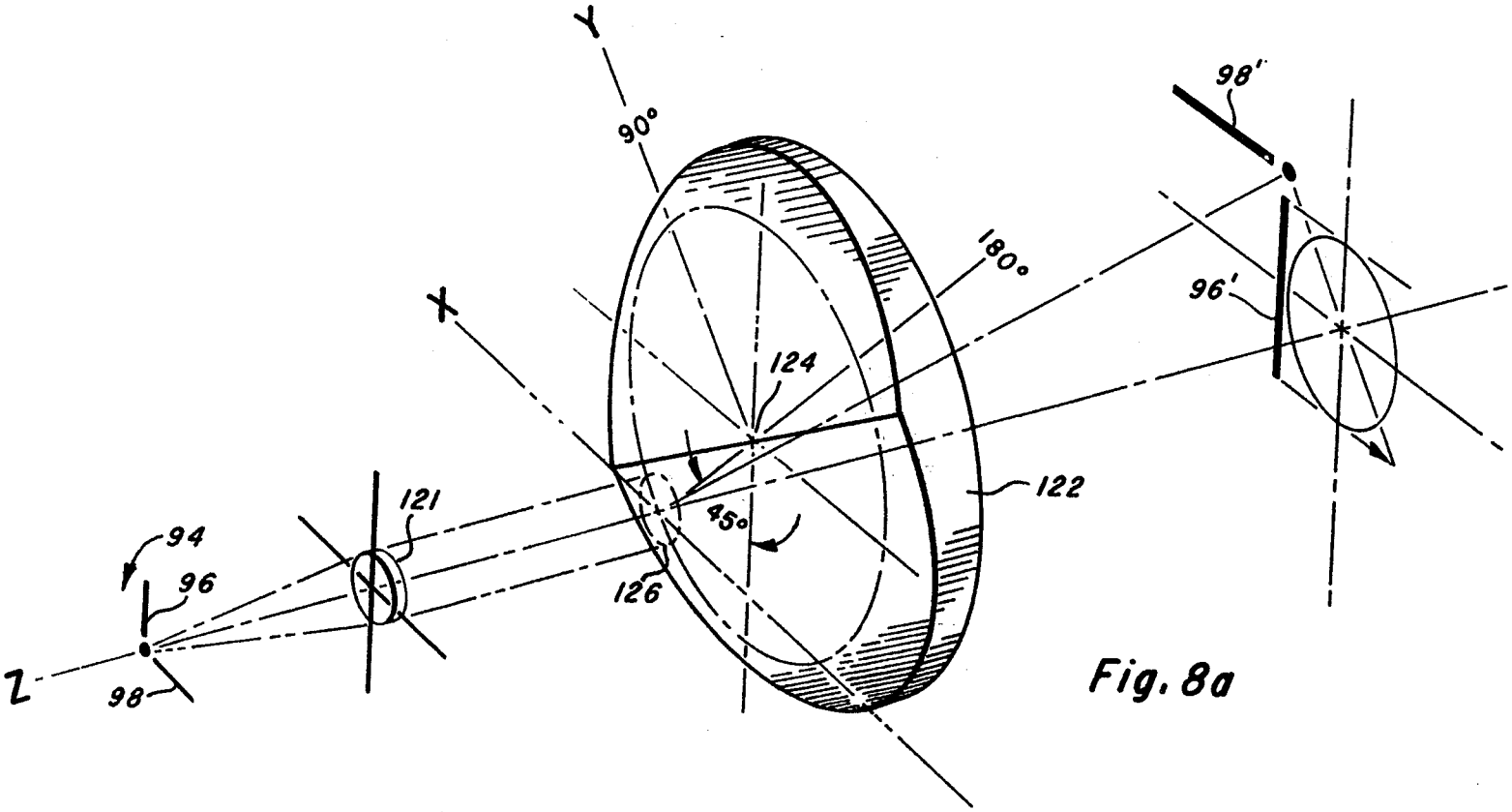
FIG. 8a is an isometric view of a fourth embodiment of the laser beam transmitter subsystem.
Figure 8D:
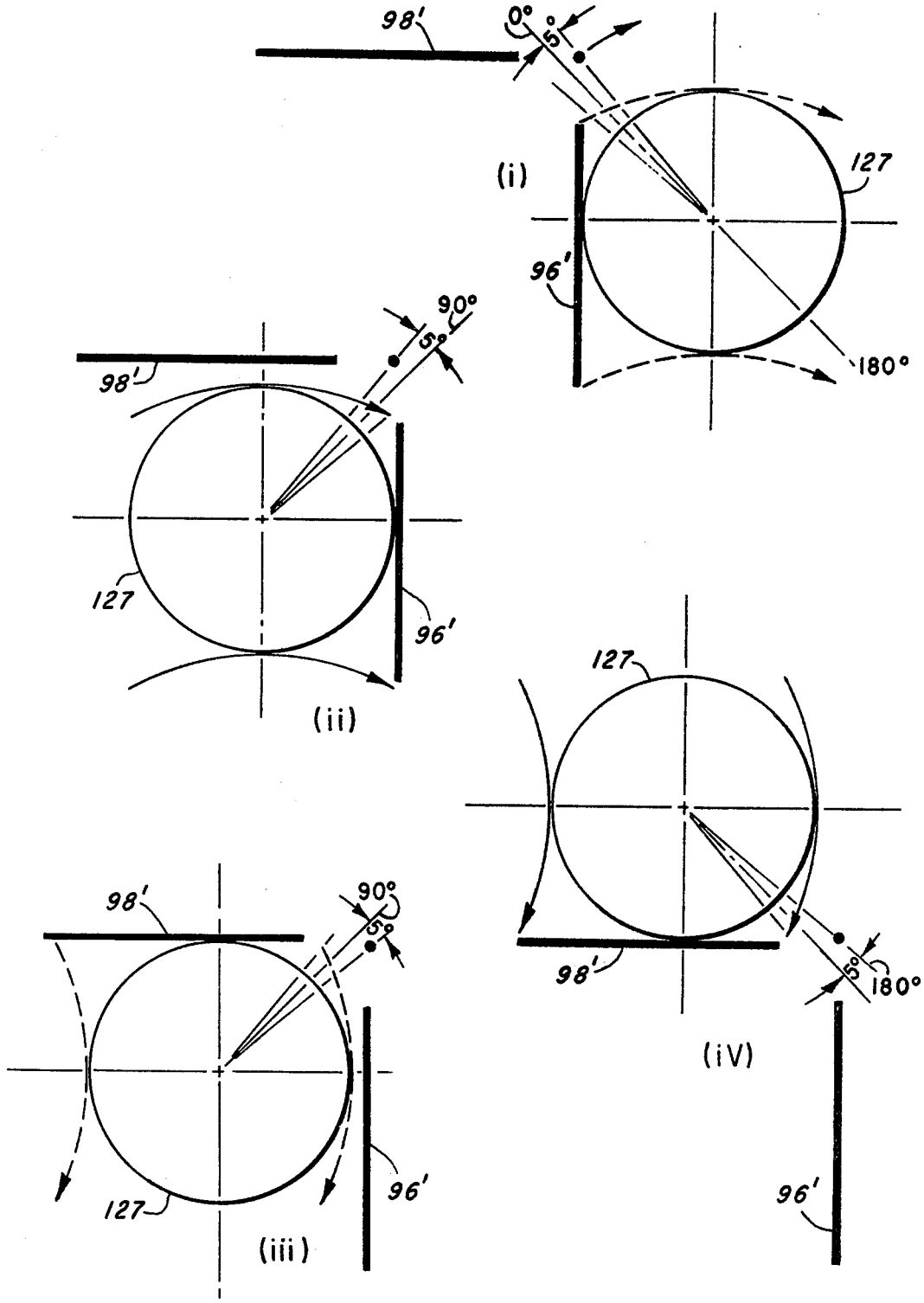
FIG. 8d depicts the scanning cycle of the field of view for one revolution of the double wedge prism as shown in FIG. 8c.
Figure 9:
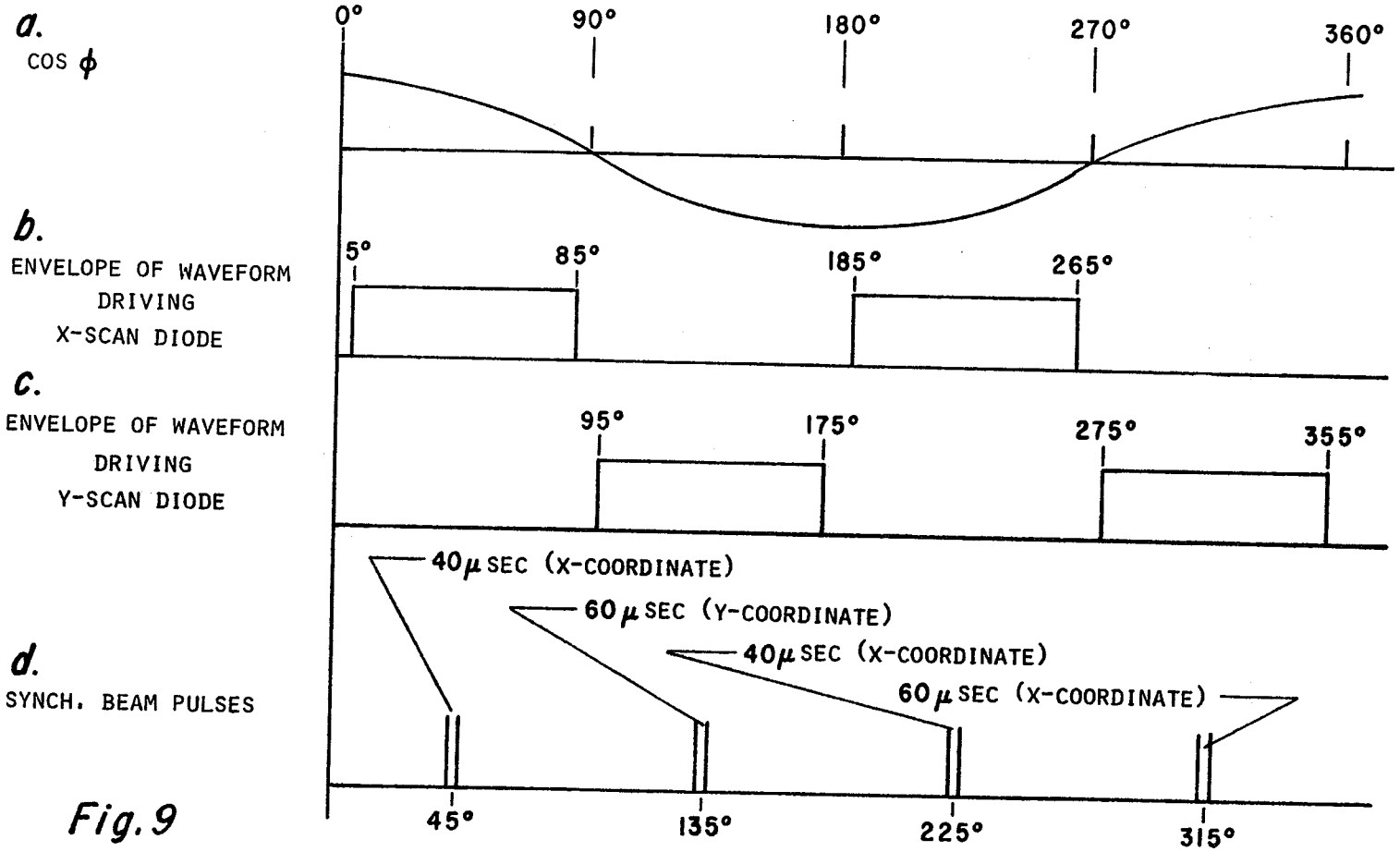
FIGS. 9a–9d are representations of the voltage waveforms driving the laser beam transmitter subsystem components of FIG. 8.

Waveforms for the laser transmitter assembly of FIG. 8 are shown in FIGS. *9a* and *9d*. In FIG. *9a*, the cosine of the phase of the double edge scanning mirror is shown for one cycle. In FIGS. *9b* and *9c*, the action of the $x$ scan diode is shown: between 0° and 5° rotation the laser diode is off; from 5° to 85° rotation, the $x$ scan beam is turned on and scanned by the first wedge of the double wedge prism 102; from 85° to 95° rotation, the laser diode is off; and at 95° rotation to 175° rotation, the $y$ scan diode junction is turned on and scanned by the first wedge of the double wedge prism 102. Thus, one scan cycle is completed during one-half revolution of the double wedge scanning 102. The envelope of waveforms driving the $x$ and $y$ scan diodes is shown in FIGS. *9b* and *9c*. As in the other embodiments, when the $x$ and $y$ scan beams cross the center line of the telescope sight the synchronization beam is pulsed to provide for each x and y scan a pair of pulses which are spaced, respectively, at 40 and 60 microsecond intervals (FIG. 9d). By comparing FIG. 9 with FIG. 7, it will be apparent from FIG. 7 that the horizontal and vertical scans of the single wedge prism are not symmetrical with respect to time, and from FIG. 9 that the horizontal and vertical scans of the double wedge prisms are symmetrical with respect to time. Thus, the data processing is simplified substantially.

Figure 10:
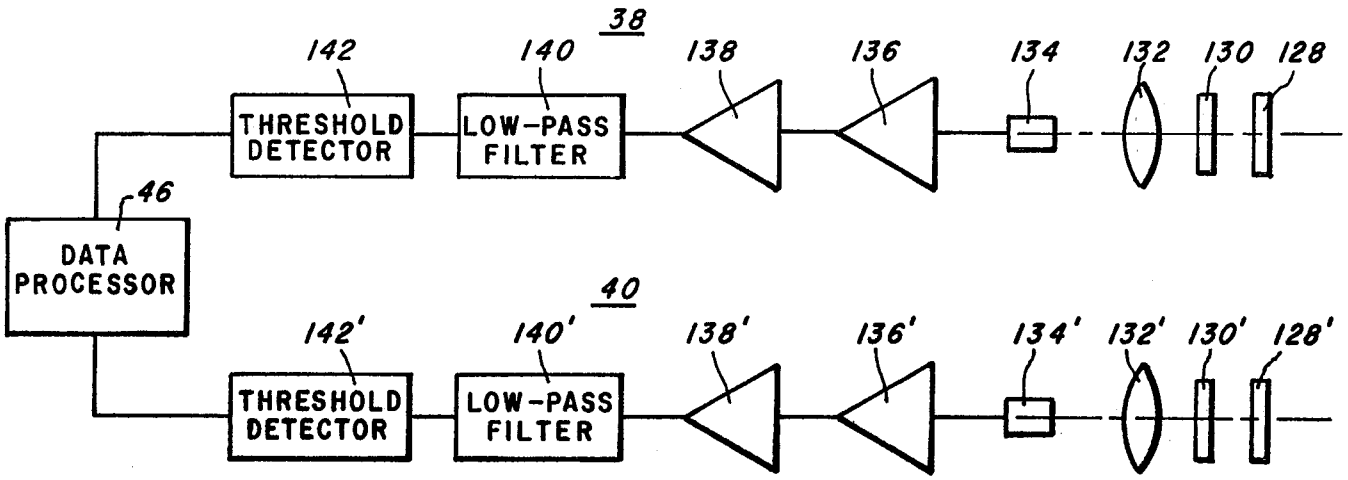
FIG. 10 is a detailed electro-optical schematic of the missile laser beam receiver subsystem.
Figure 11:
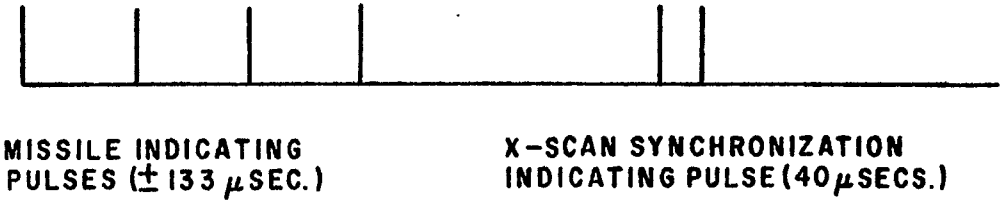
FIG. 11 pictures a typical pulse train corresponding to an $x$ scan update received by the light receiver subsystem.

Referring now to FIG. 10 in which is shown in greater detail the construction of the light receivers 38 and 40 (FIG. 2a). The receiver 38 comprises a window 128 which may be, for example, a refractory glass window. Window 128 passes laser beams to an interference filter 130 for passing light of a preselected wavelength such as, for example, the 0.904 micron wavelength of the x and y scan beams through a focusing lens 132 to a suitable light detector 134. The interference filter 130 may be, for example, an optical coating covering the window 128. A suitable light detector 134 is a silicon photodiode which produces responsively to received light an electrical signal. The light detector signal is passed to a preamplifier 136 to boost the output to an intermediate level so the signal may be further processed without appreciable degradiation of the signal to noise ratio of the system. The preamplified signal is then amplified in amplifier 138 to increase the strength of the signal without appreciably altering its characteristic waveform. The output of the amplifier 138 is then filtered in a low pass filter 140 for removing any white noise. A suitable low pass filter has a cutoff frequency between 2.5 to 10 MHz. The filtered signal is applied to a threshold detector 142 and if the amplified signals exceed a threshold, they are passed to the microprocessor. Every time a signal exceeds the threshold voltage, the microprocessor reads the counter and resets and starts the counter. The time value in the counter is stored in the microprocessor. Hence, the microprocessor 46 stores the time intervals between pulses received. When a time interval corresponding to a synchronization beam, which is 40 microseconds for an x scan beam synchronization signal is received, the microprocessor program searches for a time interval corresponding to a scan beam pulse separation (133 microseconds). Usually three or four scan beams are present in each coordinate update as shown in FIG. 11. A total time between the reception of the synchronization beam and the centroid of the three or four scan beams is directly related to the x coordinate displacement of the missile. The microprocessor is programmed to determine whether the centroid of the scan beams occur before or after the synchronization beam to determine the sign of the coordinate. If the synchronization beam pulse separation is 40 microseconds the update is for the x-coordinate. The microprocessor 46 receives roll information from the missile roll indicator 48. The coordinate updates, together with roll information are sent to the autopilot which makes the necessary corrections in the position of the appropriate missile fins.

As light receiver 40 is substantially identical to light receiver 38 prime numbers are used to identify like elements. Light receiver 40 includes a glass window 128' which passes light to an interference filter 130'. Interference filter 130' passes light having a wavelength of about 0.810 microns through focusing lens 132' to detector 134'. The detector 134' produces an electrical signal responsive to any light impinging thereon for preamplification by preamplifier 136' prior to amplification by amplifier 138'. The amplified signal is then filtered by low pass filter 140' and applied to a threshold detector 142'. Everytime a signal exceeds the threshold, the microprocessor reads the counter and resets and starts the counter. The value in the counter is stored in the microprocessor. Hence, the microprocessor stores the time intervals between pulses. When a time interval corresponding to a synchronization beam (60 microseconds for a y synchronization beam) is found, the microprocessor determines whether the centroid of the scan beam occurs before or after the synchronization beam to determine the sign of the y-coordinate. The microprocessor also receives roll information from the missile roll indicator 48. The y coordinate updates, together with missile roll information, are sent to the autopilot 146 which makes the necessary corrections in the position of the appropriate missile fins.

Although several embodiments of the invention have been described herein, it will be apparent to a person skilled in the art that carbon dioxide lasers can be used in place of laser diodes and such substitution might be desirable when used in a hazy or dense smoke environment and such use is contemplated. Various other modifications to the details of construction shown and described may be made without departing from the scope of this invention.

What is claimed is:

1. A laser beam rider guidance system comprising:

(a) a launcher based electro-optical subsystem having a laser beam transmitter assembly and an electro-optical sighting assembly, said laser beam transmitter assembly including an x and y laser scan beam producing means and a synchronization laser beam producing means, said x and y laser scan beam producing means comprising first and second elongated solid state laser diode junctions for emitting long, narrow beams of light, respectively, in the x and y directions, said electro-optical sighting assembly including a sighting means for establishing a line of sight to target, and means responsive to the x and y laser scan beams crossing the line of sight to target for actuating the synchronization beam; and (b) a laser beam receiver subsystem for mounting onboard a carrier for producing guidance signals to guide the carrier to the target in response to receipt of the x–y scan beams and synchronization beams.

2. A laser beam rider guidance system according to claim 1 wherein said first and second elongated solid state laser diode junctions are formed, respectively, in first and second laser diodes.

3. A laser beam rider guidance system according to claim 1 wherein said first and second elongated solid state laser diode junctions are mutually perpendicular for forming "L" shaped light emitting junctions in a single laser diode.

4. A laser beam rider guidance system according to claim 1 wherein the said synchronization laser beam producing means comprises an array of parallel junction laser diodes, means for actuating the laser diode array responsive to signals from the electro-optical sighting assembly and an optical beam pattern forming means in the light path of the laser diode array for selectively patterning the synchronization beam.

5. A laser beam rider guidance system according to claim 1 wherein the laser beam transmitter assembly further includes a laser beam combining means for channeling the x and y scan beams of the x and y laser scan beam producing means into a common optical path.

6. A laser beam rider guidance system according to claim 4 wherein the synchronization laser beam producing means further includes a zoom lens for focusing the synchronization beam on the laser beam receiver subsystem.

7. A laser beam rider guidance system according to claim 5 wherein the laser beam transmitting assembly further includes a zoom lens mounted in the common optical path of the $x$ and $y$ scan beams for focusing the $x$ and $y$ scan beams at the carrier to destination.

8. A laser beam rider guidance system according to claim 1 wherein the $x$ and $y$ laser scan beam producing means and synchronization laser beam producing means produce $x$ and $y$ laser scan beams and a synchronization beam at preselected wavelengths.

9. A laser beam rider guidance system according to claim 1 wherein the $x$ and $y$ laser scan beam producing means and synchronization laser beam producing means produce coded $x$ and $y$ laser scan beams and a coded synchronization beam at a single wavelength.

10. A laser beam rider guidance system according to claim 1 wherein the $x$ and $y$ laser scan beam producing means produces $x$ and $y$ scan beams at preselected wavelengths and the synchronization laser beam producing means produces a coded synchronization beam at a wavelength of one of the preselected wavelengths for the $x$ and $y$ scan beams.

11. A laser beam rider guidance system according to claim 1 wherein the on-board carrier light receiver subsystem comprises a light sensor means for detecting the $x$ and $y$ scan beams and synchronization beam, a clock, a counter coupled to the clock, and a data processor coupled to the counter, said data processor programmed to determine whether signals received from the light sensor means include an $x$ or $y$ scan beam and a corresponding synchronization beam and the time between the receipt of these beams, and to compute $x$–$y$ guidance correction signals for an autopilot to align the missile with the line of sight to target.

12. A laser beam rider guidance system according to claim 2 further comprising a drive means for oscillating the first and second laser diodes, said drive means including first and second drive mechanisms for rotating the first and second diode junctions, respectively, for scanning the laser beam in the $x$ and $y$ directions.

13. A laser beam rider guidance system according to claim 3 further including a single prism rotatably mounted in the path of the "L" shaped beams for producing $x$ and $y$ scan beams.

* * * * *